US007422661B2

(12) United States Patent
Ahvenniemi et al.

(10) Patent No.: US 7,422,661 B2
(45) Date of Patent: Sep. 9, 2008

(54) EQUIPMENT FOR LEADING A WEB THREADING TAIL IN A PAPER MACHINE

(75) Inventors: Vesa Ahvenniemi, Helsinki (FI); Bo Fagerström, Espoo (FI); Hannu Kasula, Kerava (FI); Jorma Kinnunen, Helsinki (FI); Seppo Laine, Espoo (FI); Kenneth Widell, Helsinki (FI); Juha Lipponen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 489 days.

(21) Appl. No.: 10/563,985

(22) PCT Filed: Jul. 1, 2004

(86) PCT No.: PCT/FI2004/050110

§ 371 (c)(1),
(2), (4) Date: Jan. 9, 2006

(87) PCT Pub. No.: WO2005/003453

PCT Pub. Date: Jan. 13, 2005

(65) Prior Publication Data

US 2006/0169734 A1 Aug. 3, 2006

(30) Foreign Application Priority Data

Jul. 7, 2003 (FI) ..... 20035122
Aug. 14, 2003 (FI) ..... 20035133

(51) Int. Cl.
*D21G 9/00* (2006.01)

(52) U.S. Cl. ..... 162/289; 162/273; 162/286; 162/255; 162/193; 226/92; 226/91; 34/117; 242/56.6

(58) Field of Classification Search ..... 162/289, 162/273, 193, 286, 255; 226/92, 91; 34/117; 242/56.6, 56.3
See application file for complete search history.

(56) References Cited

U.S. PATENT DOCUMENTS

| | | | | |
|---|---|---|---|---|
| 4,881,327 | A | 11/1989 | Hauser et al. | |
| 5,370,289 | A | 12/1994 | Helms | |
| 5,738,760 | A | 4/1998 | Svanqvist et al. | |
| 5,891,309 | A | 4/1999 | Page et al. | |
| 5,970,627 | A | 10/1999 | Stenz et al. | |
| 6,413,374 | B1 * | 7/2002 | Laurikainen et al. | 162/193 |
| 6,558,514 | B2 | 5/2003 | Rouhiainen et al. | |

FOREIGN PATENT DOCUMENTS

WO WO 2005/003453 A1 1/2005

OTHER PUBLICATIONS

International Search Report issued in PCT/FI2004/050110.
International Preliminary Report on Patentability issued in PCT/FI2004/050110.

* cited by examiner

*Primary Examiner*—Mark Halpern
(74) *Attorney, Agent, or Firm*—Stiennon & Stiennon

(57) ABSTRACT

Equipment for leading a web threading tail in a paper machine has at least two sequential surfaces (11) in the direction of travel of the web threading tail (10), between which a nozzle (12) is arranged to form a directed air blast and thus to transport the web threading tail (10). The equipment has an element (13) in which an exhaust zone (20) is arranged in the surface (11) before the nozzle (12) in the direction of travel of the web threading tail (10), for leading air away from the element (13) between the web threading tail (10) and the surface (11).

22 Claims, 4 Drawing Sheets

EQUIPMENT FOR LEADING A WEB THREADING TAIL IN A PAPER MACHINE

CROSS REFERENCES TO RELATED APPLICATIONS

This application is a national stage application of International App. No. PCT/FI2004/050110, filed Jul. 1, 2004, the disclosure of which is incorporated by reference herein, and claims priority on Finnish App. No. 20035122, filed Jul. 7, 2003, and Finnish App. No. 20035133, filed Aug. 14, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to equipment for leading a web threading tail in a paper machine, which equipment includes at least two sequential surfaces in the direction of travel of the web threading tail, between which a nozzle is arranged in order to form a directed air blast and thus to transport the web threading tail, being lead onto the first surface in the direction of travel of the web threading tail, onwards to the following surface.

In paper machines and in other web-forming machines, there are consecutive processing stages, through which the web is transferred with the aid of a web threading tail. In practice, the narrow web threading tail is first of all taken through the paper machine, after which it is spread out to form a full-width web. Web threading can also consist of several different stages. In a processing stage, the web threading tail is transported, for example, with the aid of web-threading ropes. However, between the processing stages there are breaks in the web threading devices, when various apparatuses are used to transport the web threading tail.

Various blast plates are known for leading the web threading tail. The operation of a blast plate is based on the Coanda phenomenon, which is created by arranging a blast of air parallel to the surface of the blast plate. A vacuum arises on the surface and sucks the web threading tail in the direction of the surface. At the same time, the blast of air pushes the web threading tail forward. If necessary, the blast plate can even be made extremely small, without any moving parts. On the other hand, connecting several blast plates in sequence will create an apparatus forming a transport path for the web threading tail.

Existing equipment based on blast plates has many problems and deficiencies. In known equipment, the air blast is created using high-pressure nozzles. In other words, the blast plates operate at an air pressure that is normally in the range of 2-6 bar (200-600 kPa), depending on the paper mill's compressed-air network. In addition, about 0.05 $m^3/s$ of compressed air is needed for each nozzle. As there can be 10-30 nozzles in a single apparatus, the consumption of compressed air is significantly large. In practice, a nozzle is formed from a duct, in which holes are machined close to each other. The holes are at intervals of about 10-20 mm and have a diameter of about 1.5 mm. The air discharges from the holes at the speed of sound. In practice, despite increasing the pressure, the speed cannot be increased above this. Though an increase in pressure will slightly increase the rate of movement of the air, in practice the increase will nevertheless be insignificant.

Air discharging from a hole at the speed of sound causes a great deal of noise. In addition, the pressure in the nozzle cannot be adjusted, should the speed of the web threading tail or the grade of paper change. In practice, the transporting force is always the same, which makes it difficult to apply the equipment to different positions. Further, the high-speed air blast creates a high vacuum precisely at the nozzle and especially after it. In practice, the web threading tail then tends to be sucked onto the surface preceding the nozzle. This abrasion creates much friction, which hampers the onward transportation of the web threading tail.

Particularly in long apparatuses, the distance between the nozzles in the machine direction is often too great. In practice, the velocity of the air blast drops rapidly after the vacuum peak following the nozzle. Thus, the force in the equipment transporting the web threading tail varies wildly, hampering web threading. In other words, the traction is discontinuous. In addition, the high-velocity air blast can even break the web threading tail. Further, known equipment lacks a force correcting the web threading tail, should the web threading tail deviate laterally from the planned path.

SUMMARY OF THE INVENTION

The invention is intended to create a new type of apparatus for leading a web threading tail in a paper machine, which is more versatile than previously and particularly which can be more precisely adjusted, and which will avoid the drawbacks in the prior art. In the equipment according to the invention, the air blast is created using a surprising construction. In the equipment, a nozzle gap is used, which, in certain embodiments, can also be adjusted simply. The nozzle gap means that an even traction, which particularly extends over a great distance, can be created with a considerably lower pressure than earlier and a lower energy consumption than previously. In addition, the tractive force is easily adjustable, making the equipment suitable for different positions and different grades of paper. The nozzle gap is formed from elements, which can be combined to form even very long apparatuses. On the other hand, even a single element, in which several nozzle gaps are formed, can be used. The use of simple elements and structures formed from them avoids the web threading tail adhering to the surface of the element. Thus, the web threading tail moves smoothly and quietly. The structure of the elements permits transport paths to be made easily, allowing the web threading tail to be transferred both vertically and laterally. In addition, the nozzle gap can be made asymmetrical, so that corrective forces can also be directed laterally to the web threading tail. The controlled elimination of excess air from between the web threading tail and the element is also important to the success of web threading.

In the following, the invention is examined in greater detail with reference to the accompanying drawings showing some embodiments of the invention.

DESCRIPTION OF THE PREFERRED EMBODIMENTS

Figures 1A, 1B, 1C:
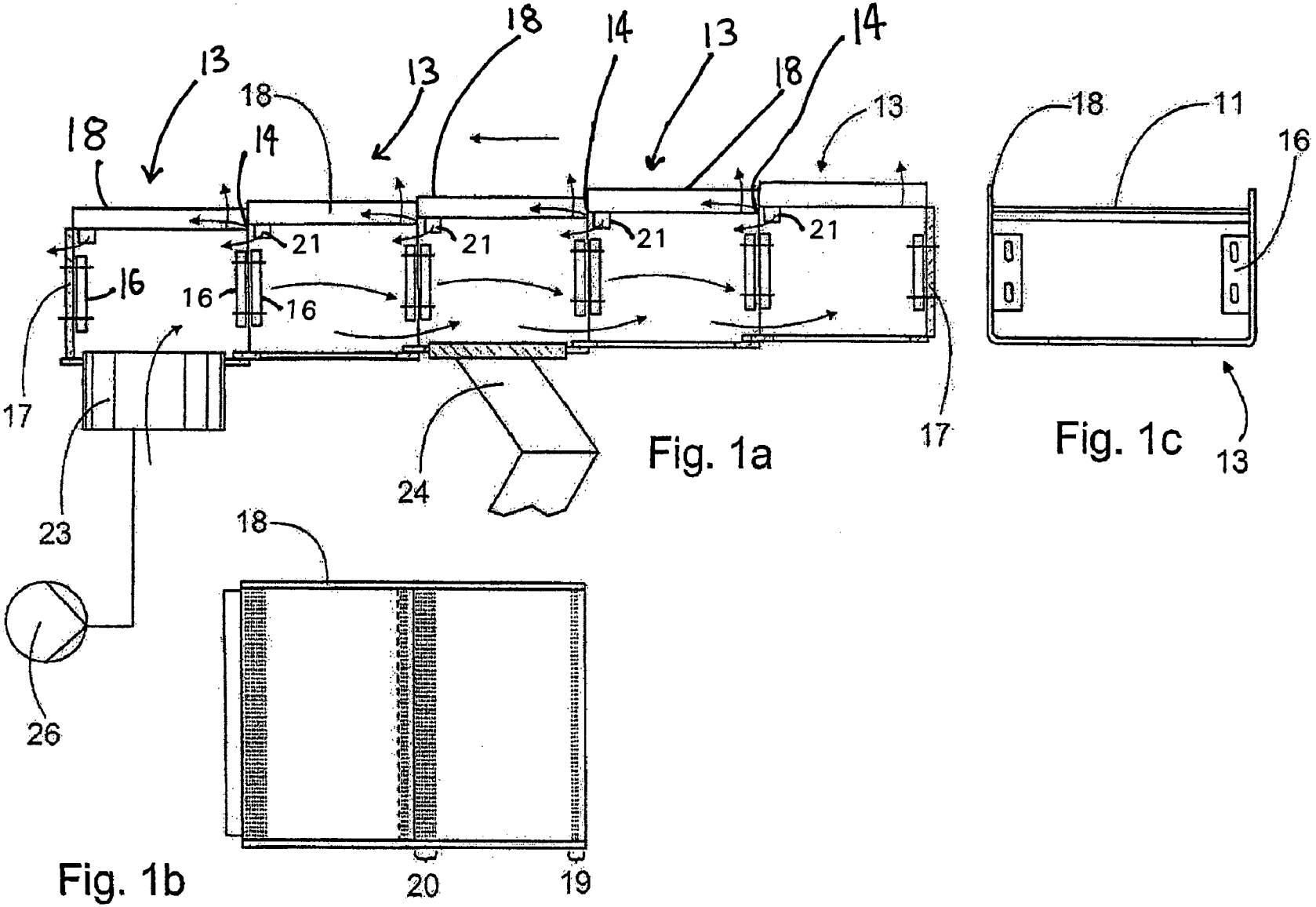
FIG. 1*a* shows a cross-section of the equipment according to the invention.
FIG. 1*b* shows a top view of part of the equipment of FIG. 1*a*.
FIG. 1*c* shows a front view of the element according to the invention.
Figure 2A:
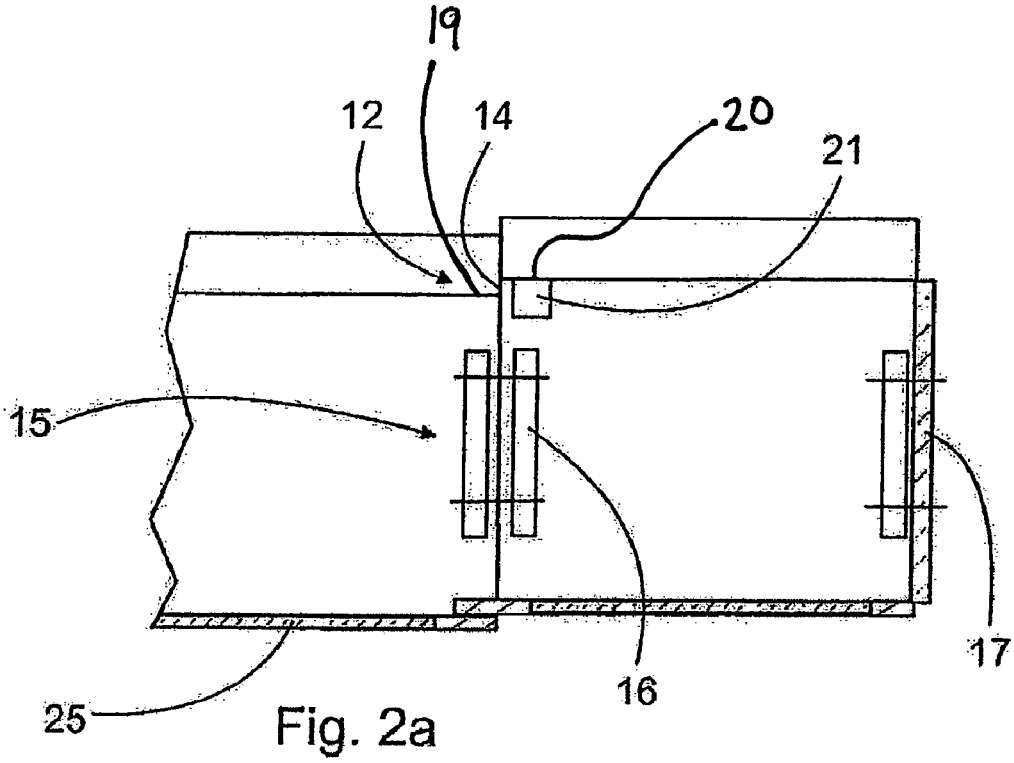
FIG. 2*a* shows a partial enlargement of the equipment of FIG. 1*a*.

FIGS. 1*a*, 1*b*, and 1*c* show the equipment according to the invention for leading a web threading tail. The equipment is used particularly in paper machines and in other web-forming machines. The equipment includes at least two sequential surfaces 11 in the direction of travel of the web threading tail 10. Part of the web threading tail 10 is shown in connection with FIG. 2*b*. A nozzle 12, for creating a directed air blast, is arranged between the sequential surfaces (FIG. 2*a*). In this way, the web threading tail 10 being lead to the first surface 11 in the direction of travel of the web threading tail is transported forwards to the following surface 11. In the figures, the direction of travel of the web threading tail is shown by a straight arrow. The same reference numbers are used for components that are functionally similar.

According to a first embodiment of the invention, the equipment includes at least two cellular elements arranged staggered relative to each other. Thus, the nozzle 12 is the gap 14 formed between the elements and the surface is the wall on the side of the said gap, of the walls delimited by the element. The staggering of the elements 13 can be seen clearly in FIG. 1*a* and the gap 14 in FIG. 2*a*. The following element 13 in the direction of travel of the web threading tail is slightly lower than the preceding one, so that a gap is formed between the walls forming the surfaces 11. By using the elements shown and particularly by using their mutual positioning, the desired properties are created simply in the nozzle 12 and the nozzle can even be adjusted. In FIG. 1*a*, five elements 13 according to the invention are joined together.

In the equipment, the sequential elements are fitted detachably to each other, using connector devices 15. The size and shape of the gap 14 can therefore be set as desired, by altering the mutual position and alignment of the elements 13. In addition, the elements 13 can be transported singly and attached to each other only at the installation site. If necessary, the number of elements 13 can be altered later and individual elements can even be replaced, if the equipment is damaged. In this case, the connector devices 15 include lugs 16 fitted inside the element 13, which are connected in the sequential elements, for example, using screws. In addition, a suitable seal can be used if necessary between the elements.

The element 13 is preferably a sheet-metal duct with an essentially rectangular cross-section. Thanks to the hollow duct, the sequential elements form an excess pressure chamber, which distributes the excess pressure over the entire length of the equipment. In addition, the rectangular elements 13 can be easily aligned relative to each other. Further, when sheet metal is used to manufacture the elements, the equipment becomes advantageously light but rigid. In addition, laser tools can be utilized to work the sheet metal, for cutting and welding. The elements are then ready for use without machining, with a high precision of dimension and shape. Thus, the elements can be dependably and easily fitted together. FIG. 1*a* also shows end pieces 17, by means of which the duct is arranged to be closed. The end piece 17 too can be advantageously attached to the aforesaid lugs 16.

Thanks to the connector devices 15, the mutual alignment of the elements 13 can be altered if necessary. In other words, the shape and size of the gap 14 can be altered nozzle-specifically, because the nozzles are formed in the joints between the elements. The connector devices 15 are shaped in such a way that, besides vertical positioning, the elements can be rotated relative to each other, allowing the direction of travel of the web threading tail to be turned. For example, a correspondingly greater mass flow forms at the larger side of a slanting gap, than at the smaller side. In that case, at a small distance from the nozzle, the static pressure is lower at the side of the larger gap. Thus, the web threading tail moves towards the lower static pressure. In this way, the web threading tail can be guided transversely to the right or the left, by simply rotating the elements relative to each other. Generally, the width of the gap should be 1-10 times wider than the web threading tail, depending on the need to guide the web threading tail in the cross-machine direction. Typically, the gap is, however, 1.2-2.5 times wider than the web threading tail. Due to the adjustment possibility described above, the gap has a quadrangular shape. The quadrangle will be either rectangular or rhombic, depending on the mutual position of the elements. Further, by rotating the elements, in extreme cases the quadrangle will shrink to form a triangle, in which case the air mass will cease to flow at one edge of the element.

According to the invention, the length of the element is 50-400 mm, preferably 100-300 mm, the length of the entire equipment being as much as 20 m. In practice, the element is thus shorter than it is wide. Without increasing the complexity of the construction or the air consumption of the equipment, the distance between nozzles can easily be made short, so that continuous traction is created over the web threading tail. In addition, short elements 13 are easy to manufacture and transport. The length of the elements 13 is mainly determined on the basis of the pressure level required in the nozzles. In practice, the height of the gap is 0.5-10 mm, preferably 1-4.5 mm, depending mainly on the grammage of the web threading tail. As the grammage increases, so does the pressure level required. In addition, an excess pressure of 1-30 kPa is used inside the element. The relevant pressure level is preferably created using a fan and, in addition, the pressure level can be regulated. At the same time, the velocity of the air discharging from the gap 14 is in the range of 40-200 m/s, which is considerably lower than in the prior art. Generally, the velocity of the air is regulated to be double the speed of the web threading tail 10. An air blast below the speed of sound also treats the web threading tail 10 considerably less roughly than air exiting at the speed of sound and reduces the probability of the web threading tail breaking. At the same time, the equipment's noise level is considerably lower than that of known equipment using high-pressure air. In the figures, the walls of the elements 13 also form sides 18, which prevent the web threading tail from escaping from on top of the equipment. Alternatively, it is possible to use, for example, plastic barriers attached to the side of the element 13.

In practice, the air discharging from the nozzle 12 has a high velocity. Correspondingly, the static pressure is consequently low compared to the static pressure prevailing elsewhere in the air flow. Thus, immediately after the nozzle, the web threading tail tends to adhere to the surface, or at least rub against the surface. To prevent adhesion and abrasion, after each gap 14 in the direction of travel of the web threading tail, there is a lubrication zone 19 in the wall forming the surface 11. The lubrication zone 19 is intended to lead air from inside the element to in between the web threading tail 10 and the surface 11. In practice, air is blown between the surface 11 and the web threading tail 10 from small holes formed in the surface. This forms an air cushion between the surface and the web threading tail, which prevents adhesion and substantially reduces friction. The diameter of the holes in the lubrication zone should be 0.2-8 mm, more typically 0.5-2.5 mm, depending mainly on the grammage and speed of travel of the web threading tail 10. Correspondingly, the distance of the holes from each other should be 1-50 mm, more typically 3-30 mm, depending mainly on the size of the holes. The lubrication zone 19 should preferably be the same width as the nozzle. Correspondingly, the length of the lubrication zone should be 0.5-100 mm, more typically 1-25 mm, depending on the grammage of the paper. Generally, the lubrication zone formed by a hole or holes extends over the entire width of the element 13 and has a length of 5-30 percent, preferably 10-20 percent of the length of the element.

Figure 2B:
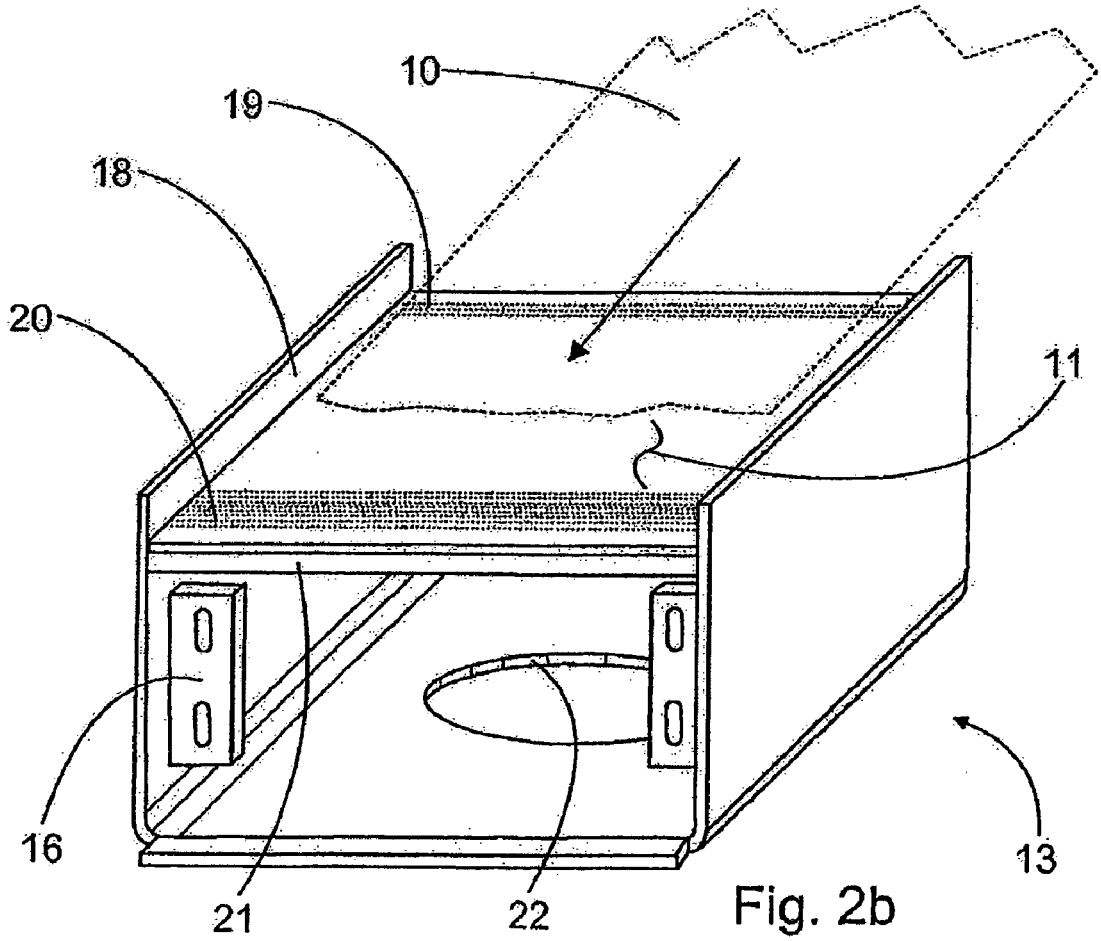
FIG. 2*b* shows an axonometric view of the element of FIG. 1*c*.

The velocity of the air discharging from the nozzle 12 naturally diminishes as it travels farther from the nozzle, so that the web threading tail 10 will tend to detach from the surface 11. This is, in turn, disadvantageous in terms of utilizing the tractive force of the following nozzle. According to the invention, there is an exhaust zone 20 on the surface 11 before the nozzle 12, in the direction of travel of the web threading tail. The exhaust zone 20 is intended to conduct the air away from the element 13 from between the web threading tail and the surface 11. Preferably, there is an exhaust zone before each nozzle. In the first embodiment, exhaust channels 21 are also used. This ensures the optimal distance of the web threading tail 10 from the surface 11 at the following nozzle 12. At the same time, the web threading tail 10 remains at a suitable distance over the entire equipment. The perforation of the exhaust zone 20 and its width in the cross-machine direction are essentially the same as in the aforesaid lubrication zone. The length of the exhaust zone in the machine direction, however, should be 5-250 mm, more typically 50-200 mm, depending mainly on the length of the element and the speed of the web threading tail. The exhaust zone can even be very long, as after the blast there is excess air between the web threading tail and the surface. However, the center point of the exhaust zone 20 should be located sufficiently far from the start of the element 13 to ensure undisturbed operation of the air blast. The zones 19 and 20 shown in FIGS. 1*b* and 2*b* are formed of small holes. Instead of holes, narrow slots arranged at an angle to the direction of travel of the web threading tail 10, can also be used. The zone will then be comprehensive, without isolated areas. The same effect can also be achieved by staggering the positions of the holes.

Figure 3:
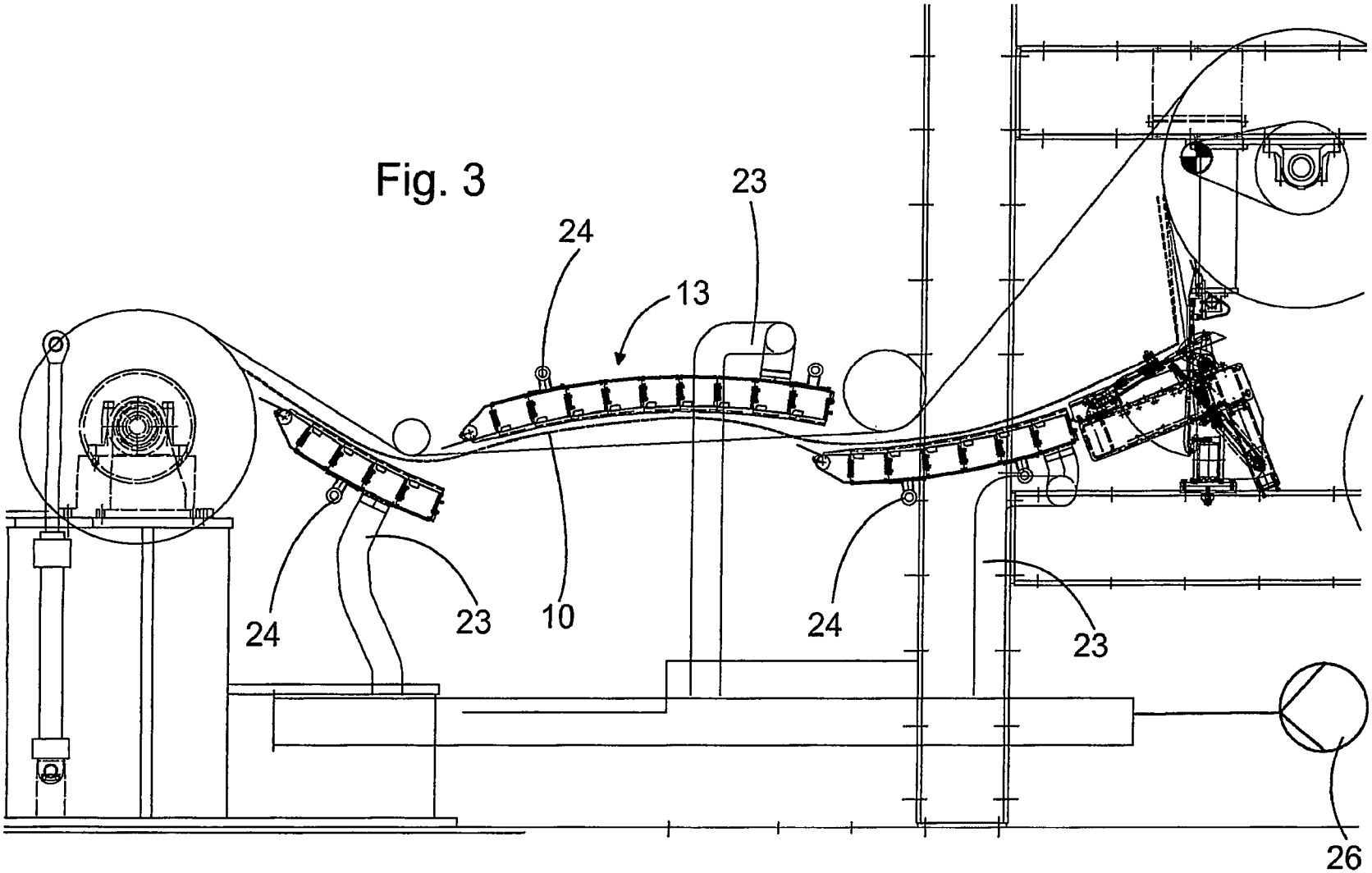
FIG. 3 shows three sets of equipment according to the invention installed sequentially in a paper machine.

According to the invention, the excess pressure is surprisingly created using a fan 26 (FIGS. 1*a* and 3). The production of the pressure will then be economical and the amount of air can be easily regulated and increased. For this purpose, the equipment includes a fan 26 for feeding air into the elements 13. In addition, the fan 26 is preferably a fan of some other device in the vicinity of the equipment, which other device is switched off during web threading. This will further reduce the acquisition and operating costs of the equipment. For example, the fan of the dryer is switched off during web threading, allowing the fan in question to be used to pressurize the equipment.

The air required by the equipment is thus produced using a fan 26, making high-pressure compressed air unnecessary. The air produced by the fan 26 is led into the chamber formed by the elements 13 through one or two large hoses. The velocity and pressure of the air required by the equipment are dependent on the speed of the web threading tail 10. By using low-pressure air and the equipment according to the invention the velocity and pressure of the air can be regulated by simply adjusting the fan 26. In practice, nearly stepless regulation can be achieved by using a frequency converter to alter the speed of rotation of the fan 26. Thus, despite the change in grammage caused by changes of paper grade, one and the same set of equipment can be used to transport the web threading tail 10. When changing between different grades, adjustment of the fan 26 is all that is needed. The investment costs of the equipment are also reduced by the lack of compressed-air hoses, connectors, and valves. In addition, compressed air is more economically produced with a fan than with a compressor.

Thanks to the nozzles formed by the gaps, the excess pressure required is considerably low. The pressure level inside the equipment should be 1-30 kPa, more typically 5-15 kPa, greater than the ambient pressure. The excess pressure in question can be achieved already with a single fan. The excess pressure required depends mainly on the speed and grammage of the web threading tail. In its simplest form, the exhaust channel under the exhaust zone discharges into the environment. To exhaust the air more effectively, a vacuum can also be arranged in the exhaust channel. The pressure level in the exhaust channel should then be 0.01-15 kPa, more typically 0.05-5 kPa lower than the ambient pressure, depending on the size of the holes and the exhaust zone.

Each element is essentially identical and there is an opening 22 in at least one wall of the element 13. In FIG. 2*b*, the opening 22 is in the bottom of the element 13, but it can also be located in the side walls. The opening 22 is arranged to be filled using a connection for leading air into the elements. In FIG. 1*a*, the connection 23 is attached to the final element 13 and a hose coming from the fan 26 is attached to the connection 23. Alternatively, the opening 22 is closed using an attachment bracket 24, in order to support the equipment from the paper machine. In FIG. 1*a*, the attachment bracket 24 is fitted to the middle element 13. The openings in the other elements 13 are closed using plugs 25, as shown in FIG. 2*a*. FIG. 1*a* also shows the flow of the air. The air is led into the equipment through a connection 23, from where it discharges through the gaps 14 to transport the web threading tail. The air also flows through the lubrications zones 19. In the exhaust zone 20, the air travels correspondingly through the holes to the exhaust channel 21 and from there out of the equipment.

FIG. 3 shows three sets of equipment according to the invention installed sequentially in a paper machine. The path of the web threading tail 10 during web threading is shown here by a broken line and the path of the web by a solid line. When web threading starts, the web threading tail 10 is detached from the surface of the final dryer cylinder and guided to the first set of equipment. The sets of equipment are arranged in such a way that the web threading tail 10 runs from one set to another without any separate auxiliary devices. In this case, the equipment includes a special end piece, with an adjustable guide strip. The elements shown are, in addition, curved, there being nine of them, in addition to the end piece, in the middle set of equipment. The fan 26 is shown schematically and is used to blow air into all three sets of equipment. By using at least partly flexible connections 23, the position of the equipment can, if necessary, be adjusted by altering the position of the attachment brackets 24.

Figure 4A:
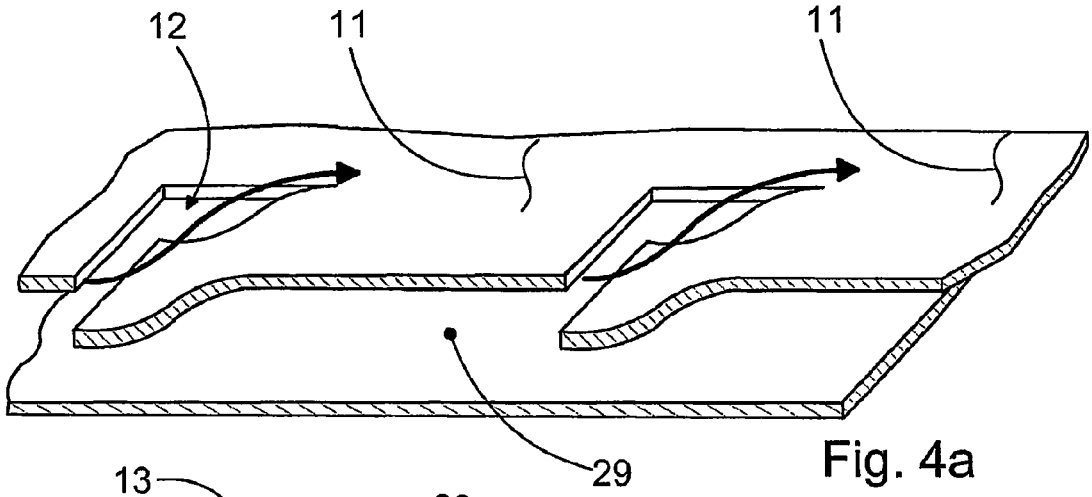
FIG. 4*a* shows a schematic diagram of a second embodiment of the nozzle gap of the equipment according to the invention.
Figure 4B:
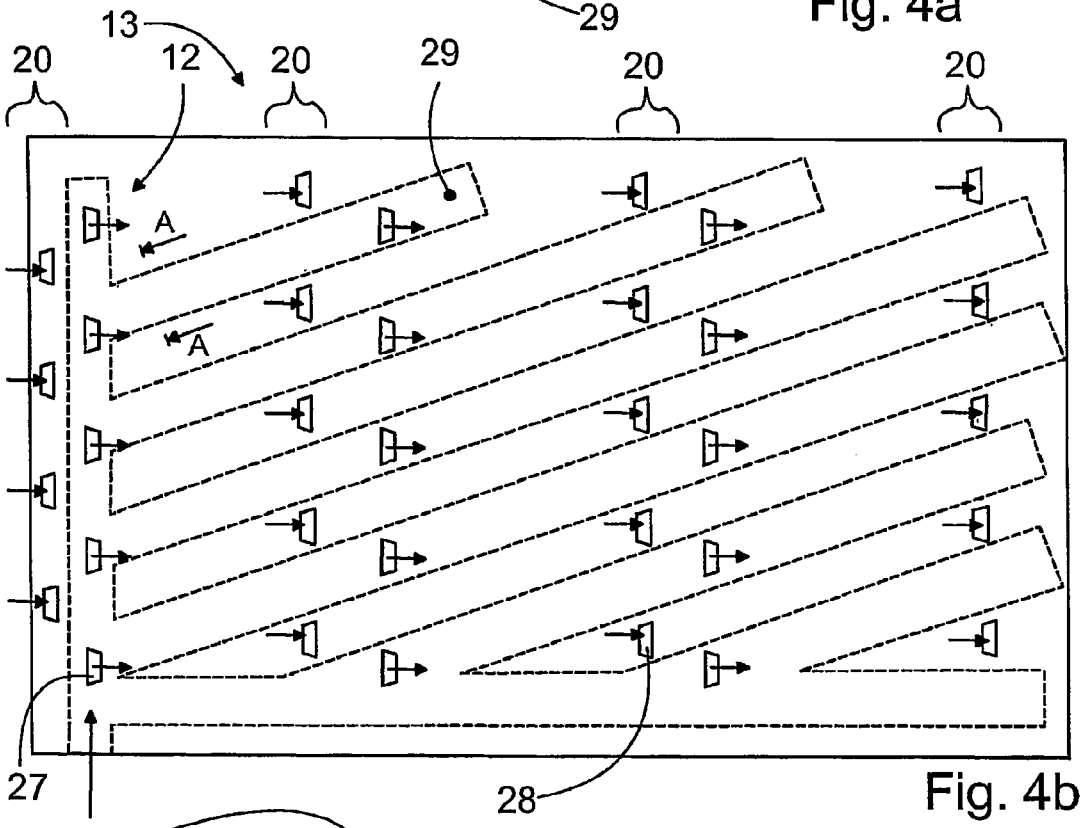
FIG. 4*b* shows a top view of a second embodiment of the equipment according to the invention.

In the embodiment of FIG. 3, the web threading tail is transported for several meters. In a paper machine, there may be positions, in which it is difficult to find space for even two elements. In that case, the embodiment shown in FIG. 4*b* can be used. FIG. 4*b* shows a single element 13, several of which can, if necessary, be either installed sequentially, or else used singly. In this case, the element 13 is flat, but has several nozzles 12 in both the transverse and longitudinal directions. Here too, the nozzle 12 is a gap nozzle, which is formed of a blast opening 27 arranged in the base material of the surface 11 of sheet material. Correspondingly, the exhaust zone 20 is formed of a single or several exhaust openings 28, the construction of which is arranged to be similar, but opposite to the construction of the blast opening 27. Thus, the web threading tail 10 remains at a suitable distance from the surface. In addition, the use of the element 13 creates a controlled and smooth airflow on the surface 11, so that the sensitivity of the web threading tail 10 to errors in direction is reduced. The tail 10 can also be easily controlled while the air consumption is smaller than that of the prior art. The use of several blast openings creates an undisturbed and laminar air blast for the desired distance over the entire element.

A second embodiment of the equipment according to the invention has blast openings at specific intervals over the area of the entire surface, making the air blast as even as possible over the entire plate. The blast openings 27 are shaped in such a way that they disturb the flow parallel to the surface 11 as little as possible (FIG. 4*a*). The structure of an exhaust opening is thus similar to that of a blast opening, but is set against the airflow. Thus, it removes part of the air flowing on the surface, without disturbing the total flow, just like a sports car's air scoop.

Figure 4C:
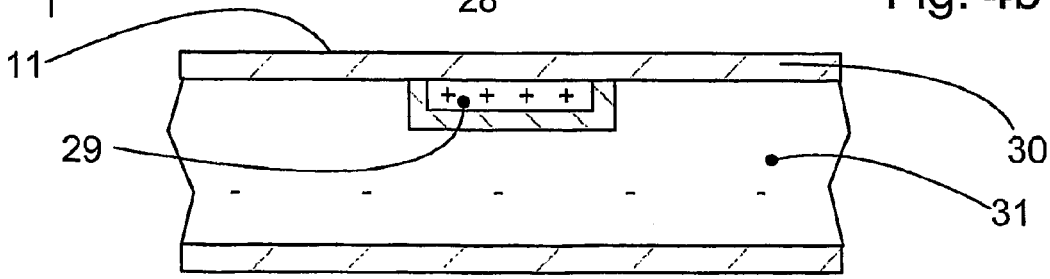
FIG. 4*c* shows a partial cross-section of the plane A-A of FIG. 4*b*.

In the element according to the invention, the sizes of the blast openings are in the order of 1-2 mm. The number and size of the blast and exhaust openings are dimensioned as required. The exhaust openings can operate at either normal air pressure, or be equipped with a vacuum, so that the exhausting of the air is made more efficient. FIG. 4*c* shows a partial cross-section of an element 13 according to the invention. In this case, the air being blown and the air being sucked are separated from each other, in such a way that there is, for example, an air channel 29, into which the compressed air going to the blast openings is led, implemented by the sheet-metal technique, in the lower surface of the upper plate 30 of the case-like element 13. FIG. 4*b* shows several air channels 29.

In this case too, the element can, in addition, be shaped quite freely, permitting even complicated web threadings, such as, for example, those in surface-gluing and coating stations, and in calenders. Especially without suction, the casing construction is unnecessary. In such a case, the element has only an upper plate and the air channels in it. On the other hand, the element can also be equipped with an opening bottom, allowing the vacuum chamber 31 and the exhaust openings to be easily cleaned when necessary. Correspondingly, steam or water can also be fed into the air channels, to remove impurities. The plate forming the surface of the element can be implemented, for example, by rolling the pattern of the blast and exhaust openings already into the plate, in the same way as into a tear-patterned plate. In that case, the only work stage remaining is to open the rolled recesses to form openings. Another way of making the openings is stamping, when a precise shape is created in the openings. The essential feature is the lack of separate nozzles, as the necessary gaps are created between the elements, or the base material of the plate material.

The equipment according to the invention is reliable in operation and can be applied in connection with different paper grades. In addition, the equipment can be adjusted comprehensively and it is economical to use. Further, varying paths for the web threading tail to be transported can be formed from the elements. In addition, the sequential elements can be installed at an angle to each other, so that curved paths can be made. In the embodiment shown, the web threading tail is transported on the upper surface of the equipment. By arranging the equipment upside down, the web threading tail can also be transported on the lower surface. In that case, the equipment and particularly the surface and zones will remain clean. On the other hand, it is possible to use even a single element, by arranging several gaps sequentially.

The invention claimed is:

1. Equipment for leading a web threading tail in a paper machine comprising:

a first cellular element having a first surface for conducing a threading tail in a direction of travel;

a second cellular element having a second surface sequential in the direction of travel with respect to the first surface, the second surface for conducing the threading tail, the first surface and the second surface defining a gap therebetween, the gap forming a nozzle directed over the second surface;

wherein the first cellular element and the second cellular element are sequential and are arranged in a staggered manner relative to each other to form the gap between the first cellular element and the second cellular element;

wherein the first surface is a wall of the first cellular element on a first side of the gap and the second surface is a wall of the second cellular element on a second side of the gap; and wherein the first cellular element and the second cellular element are arranged to form a duct for distributing pressurized air form the first element to the second element and any further element.

2. The equipment of claim 1 further comprising a plurality of sequential elements arranged to form the duct for distributing pressurized air, each sequential element forming a gap with a preceding element, the gap forming a nozzle directed over a surface of the sequential element.

3. The equipment of claim 2 wherein after the gap in the direction of travel of the web threading tail, there are portions of each element which form openings for conducting air from inside the cellular element between the web threading tail and the surface forming a lubrication zone, so as to allow air from inside the cellular element to flow between the web threading tail and the surface; and wherein, before the nozzle in the direction of travel of the web threading tail, portions of the first surface form an exhaust zone connected to a region of pressure below atmospheric for leading air through the first surface; and wherein the exhaust zone and the lubrication zone extend over the entire width of each element and the exhaust zone and the lubrication zone each have a length in the direction of travel which is 5-30 percent of a length of the element in the direction of travel.

4. The equipment of claim 2 wherein each of the plurality of sequential elements is essentially identical and wherein in at least one wall of each element there is an opening which is filed with a member selected from the group consisting of: a connection to a supply of pressurized air, a support bracket for supporting the equipment from the paper machine, and a plug which closes the opening.

5. The equipment of claim 1 wherein the gap defines a height of from 0.5-10 mm.

6. The equipment of claim 2 further comprising a fan in air supplying relation to said plurality of elements.

7. The equipment of claim 6, wherein the fan is arranged in air supplying relation to a device in addition to said plurality of elements, and wherein the fan is arranged to be switched between said plurality of elements and said device.

8. The equipment of claim 2, wherein the preceding element has portions forming openings in a surface to form an exhaust zone before the nozzle of each sequential element.

9. The equipment of claim 8 wherein an exhaust channel, which is connected to the exhaust zone, is arranged in each element.

10. The equipment of claim 1 wherein portions of the first surface form openings in the first surface, defining an exhaust zone, the openings in the first surface leading to a channel containing air of lower than atmospheric pressure, wherein the exhaust zone is positioned before the nozzle in relation to the direction of travel.

11. The equipment of claim 1 wherein the first cellular element and the second cellular element are fitted detachably to each other using connector devices, for setting the size and shape of the gap to a selected configuration, by altering the mutual position and alignment of the first cellular element and the second cellular element.

12. The equipment of claim 1 wherein the first cellular element and the second cellular element which form the duct are made of sheet metal with a cross-section of an essentially rectangular shape, wherein each of the first cellular element and the second cellular element has an end, and further comprising an end piece connected to at least one cellular element to thereby close said end.

13. The equipment of claim 1, wherein the length of each of the first cellular element and the second cellular element in the direction of travel is 50-400 mm.

14. The equipment of claim 1, wherein the length of each of the first cellular element and the second cellular element in the direction of travel is 100-300 mm.

15. The equipment of claim 1 wherein after the gap in the direction of travel of the web threading tail, there is a lubrication zone in the second surface, for conducting air from inside the second cellular element between the web threading tail and the surface.

16. The equipment of claim 1, wherein, before the nozzle in the direction of travel of the web threading tail, portions of the first surface form an exhaust zone connected to a region of pressure below atmospheric for leading air through the first surface.

17. Equipment for leading a web threading tail in a paper machine comprising;

a least one element having a first upper surface for conducing a threading tail in a direction of travel;

at least one channel mounted below selected portions of the first upper surface, the at least one channel being connected to a source of pressurized air;

portions of the first upper surface of the element which form first downward extensions which extend into the at least one channel to define blast openings in the upper surface, the downward extensions arranged to deflect air on to the upper surface; and portions of the upper surface of the element forming second downward extensions, which do not extend into the at least one channel, the second downward extensions defining exhaust openings in the upper surface, the downward extensions arranged to conduct air away from the upper surface.

18. The equipment of claim 17 further comprising a vacuum chamber mounted below the upper surface, wherein the second downward extensions define the exhaust opening into the vacuum chamber.

19. The equipment of claim 17 wherein the first downward extensions and the second downward extensions have similar shape but are arranged as mirror image structure.

20. An apparatus for leading a web threading tail along a direction of travel in a paper machine, the apparatus comprising:

a first element having a conveying surface extending between two side walls, the first element having portions defining a pressurized passage; and a second element having a conveying surface extending between two side walls, the second element having portions defining a pressurized passage, the second element being connected to the first element downstream of the first element such that the first element conveying surface is staggered from the second element conveying surface to define a gap therebetween, the gap defining a nozzle through which air introduced into the first element pressurized passage escapes to pass over the second element conveying surface as a directed air blast, to thereby transport the web threading tail from the first element conveying surface in the direction of travel of the web threading tail onwards to the second element conveying surface, the second element pressurized passage being in communication with the first element pressurized passage to allow the distribution of air inside the elements from one element to another.

21. The apparatus of claim 20 further comprising portions of the first element conveying surface which define openings in the surface to define an exhaust zone upstream of the nozzle in the direction of travel of the web threading tail, for leading air away from the first element between the web threading tail and the first element conveying surface.

22. The apparatus of claim 20 further comprising portions of the second element conveying surface which define a lubrication zone downstream of the gap between the first element and the second element conveying surfaces, the lubrication zone being comprised of openings which communicate with the pressurized passage of the second element to permit the escape of pressurized air therethrough.

* * * * *